US006158059A

United States Patent [19]

Zhang

[11] Patent Number: 6,158,059

[45] Date of Patent: Dec. 12, 2000

[54] FOOT ACTUATED TOILET SEAT LIFT

[76] Inventor: Xin Zhang, 1070 Carolan Ave. #208, Burlingame, Calif. 94010

[21] Appl. No.: 09/477,218

[22] Filed: Jan. 4, 2000

[51] Int. Cl.[7] ..... A47K 13/10

[52] U.S. Cl. ..... 4/246.2; 4/246.1; 4/246.3

[58] Field of Search ..... 4/246.1, 246.2, 4/246.3, 246.4, 246.5, 248; 220/262, 263, 264

[56] References Cited

U.S. PATENT DOCUMENTS

| | | | |
|---|---|---|---|
| 1,195,481 | 8/1916 | Legat et al. . | |
| 1,365,686 | 1/1921 | Harvey . | |
| 2,849,728 | 9/1958 | Gyllenberg . | |
| 4,592,097 | 6/1986 | Zimmerman | 4/251 |
| 4,975,988 | 12/1990 | Won | 4/251 |
| 5,103,506 | 4/1992 | Munford et al. | 4/251 |
| 5,504,947 | 4/1996 | Robello et al. | 4/246.1 |
| 5,806,106 | 9/1998 | Carter et al. | 4/246.1 |

*Primary Examiner*—Henry J. Recla
*Assistant Examiner*—Khoa Huynh

[57] ABSTRACT

A foot actuated toilet seat lift comprises a lifting mechanism, a pedal assembly and mechanism for transmitting the force provided by toilet users' foot from the pedal assembly to the lifting mechanism. The lifting mechanism has a base adapted to be mounted on a toilet, a base cover resting on top of the base, a carriage mounted on one end of the base, a guiding roller rotatably mounted on the head of the carriage, a semicircle bar attached to one side of the carriage, a leaf spring mounted on one end of the base under the carriage, a pin roller movably resting on the leaf spring, a lifting arm rotatably resting in the carriage under the guiding roller, and a contact roller rotatably attached to the straight end of the lifting arm. The pedal assembly has a foot-receiving pad and a base, a number of links pivotally attached at the underside of the foot-receiving pad at one end, and movably mounted on the pedal base at another end, a number of rollers rotatably attached to the links, a mechanism for locking and releasing the pedal, and a bellows bonded on the underside of the foot-receiving pad at one end and on the pedal base at another end.

10 Claims, 13 Drawing Sheets

FOOT ACTUATED TOILET SEAT LIFT

BACKGROUND

1. Field of Invention

This invention relates to toilet seat lifting devices, specifically to such devices that are actuated by toilet user's foot.

2. Description of Prior Art

Lifting or reseating a toilet seat by hand upon using toilet is a matter that is routine but inconvenient, unhealthy, and disgusting for everyone. Therefore, inventors created a number of toilet seats lifting devices that enable toilet users to lift or reseat a toilet seat by foot instead of hand. However, due to some evident disadvantages none of the prior art devices have achieved wide acceptance and got the access to the market. For instance, some devices such as that disclosed in U.S. Pat. No. 4,975,988 to Won or U.S. Pat. No. 5,404,595 to Carmel contain a specially designed toilet seat which is deferent in structures from the regular ones. The adoption of these devices requires a replacement of millions of existing toilet seats and in consequences causes huge waste. Some devices such as that disclosed in U.S. Pat. No. 5,444,877 to Kumarasurier only can be used for the type of toilets which have a bowl and a tank built separately and have a flat pedestal between, but not for the type of toilets which have a bowl and a tank built together and the pedestal between them is not flat. Some devices such as that disclosed in U.S. Pat. No. 4,649,576 to Lillie give no protection against slamming during seat lifting or reseating operation, which may damage toilets or toilet seats. In addition, some devices require complicated manufacturing procedures for their production, which can be costly; or need elaborate installations done by professionals, which may increase users' expenses and inconvenience.

OBJECTS AND ADVANTAGES

Accordingly, several objects and advantages of the present invention are:

(a) To provide a foot actuated toilet seat lift that frees toilet user's hand from lifting or reseating a toilet seat when using toilet.

(b) To provide a toilet seat lift which can be used for the toilet seats that are currently in use without making any changes on them.

(c) To provide a toilet seat lift which can be used on any type of conventional toilets.

(d) To provide a toilet seat lift that prevents toilets and toilet seats from slamming.

(e) To provide a toilet seat lift which can be easily manufactured at low costs.

(f) To provide a toilet seat lift that can be easily installed by toilet users themselves.

(g) To provide a toilet seat lift that is very flexible in dimensions or colors to fit a variety of toilets or toilet seats.

DRAWING FIGURES

REFERENCE NUMERALS IN DRAWINGS

Figure 1:
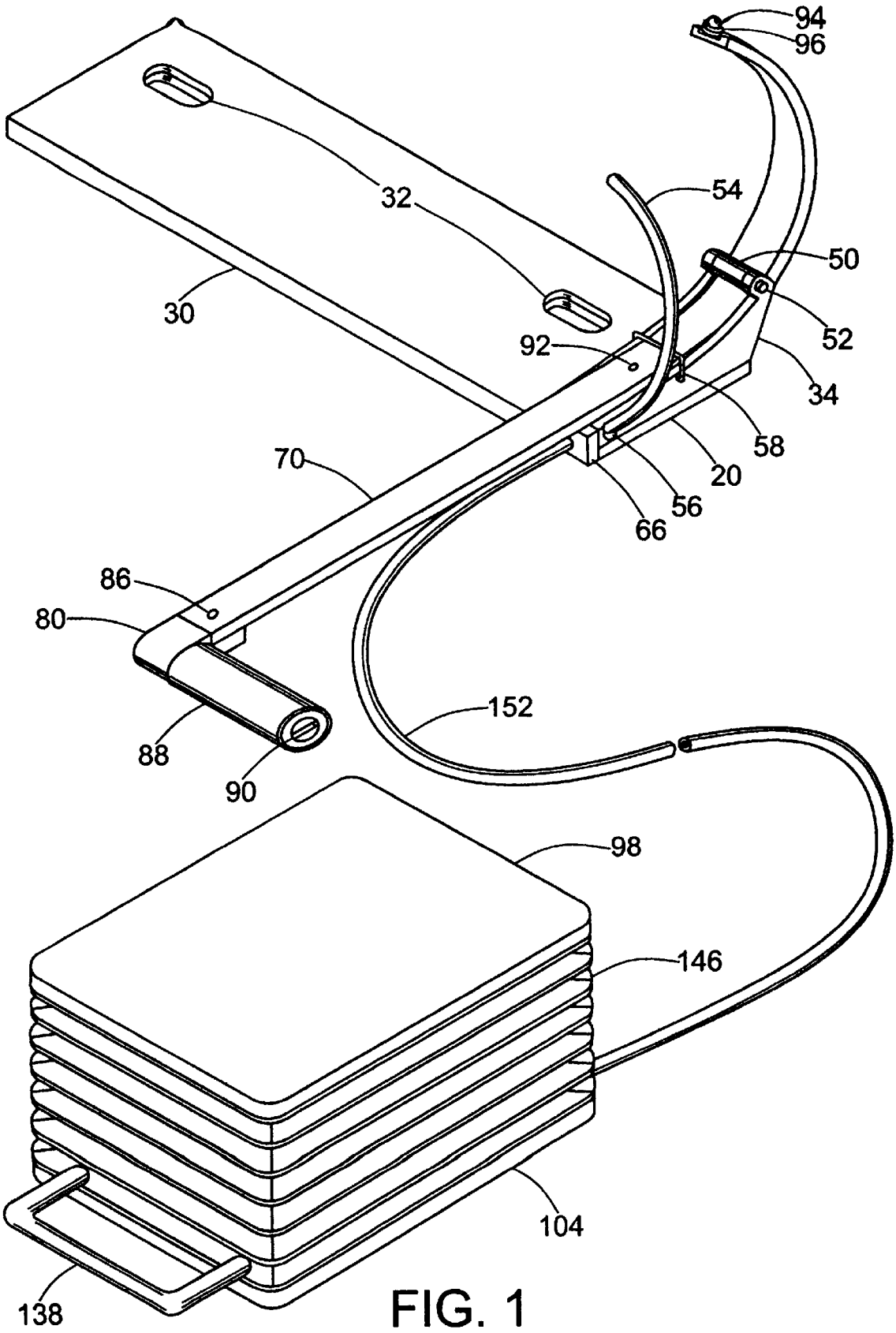
FIG. 1 shows a typical embodiment of the foot actuated toilet seat lift.

20 base of the lifting mechanism
22 slot
24 groove
26 through-hole
28 threaded hole
30 base cover
32 slot
34 carriage
36 threaded hole
38 threaded hole
40 through-hole
42 through-hole
44 slot
46 screw
48 screw
50 guiding roller
52 pin
54 semicircle bar
56 screw
58 locking member
60 leaf spring
62 slot
64 pin roller
66 cable anchor
68 through-hole
70 lifting arm
72 groove
74 threaded hole
76 through-hole
78 threaded hole
80 roller bearing
82 threaded hole
84 through-hole
86 screw
88 contact roller
90 bolt
92 pin
94 screw
96 washer
98 foot-receiving pad
100 link mount
102 through-hole
104 base of the pedal assembly
106 guide
108 slot
110 notch
112 threaded hole
114 link
116 through-hole
118 threaded hole
120 pin
122 roller

124 axle
126 screw
128 pin
130 roller
132 bushing
134 bar
136 through-hole
138 lever
140 bracket
142 through-hole
144 screw
146 bellows
148 notch
150 notch
152 cable
154 cable cap Description—FIGS. 1–6

A typical embodiment of the foot actuated toilet seat lift of the present invention is illustrated in FIG. 1. A lifting mechanism, a pedal assembly, and a cable constitute the lift.

Figure 2:
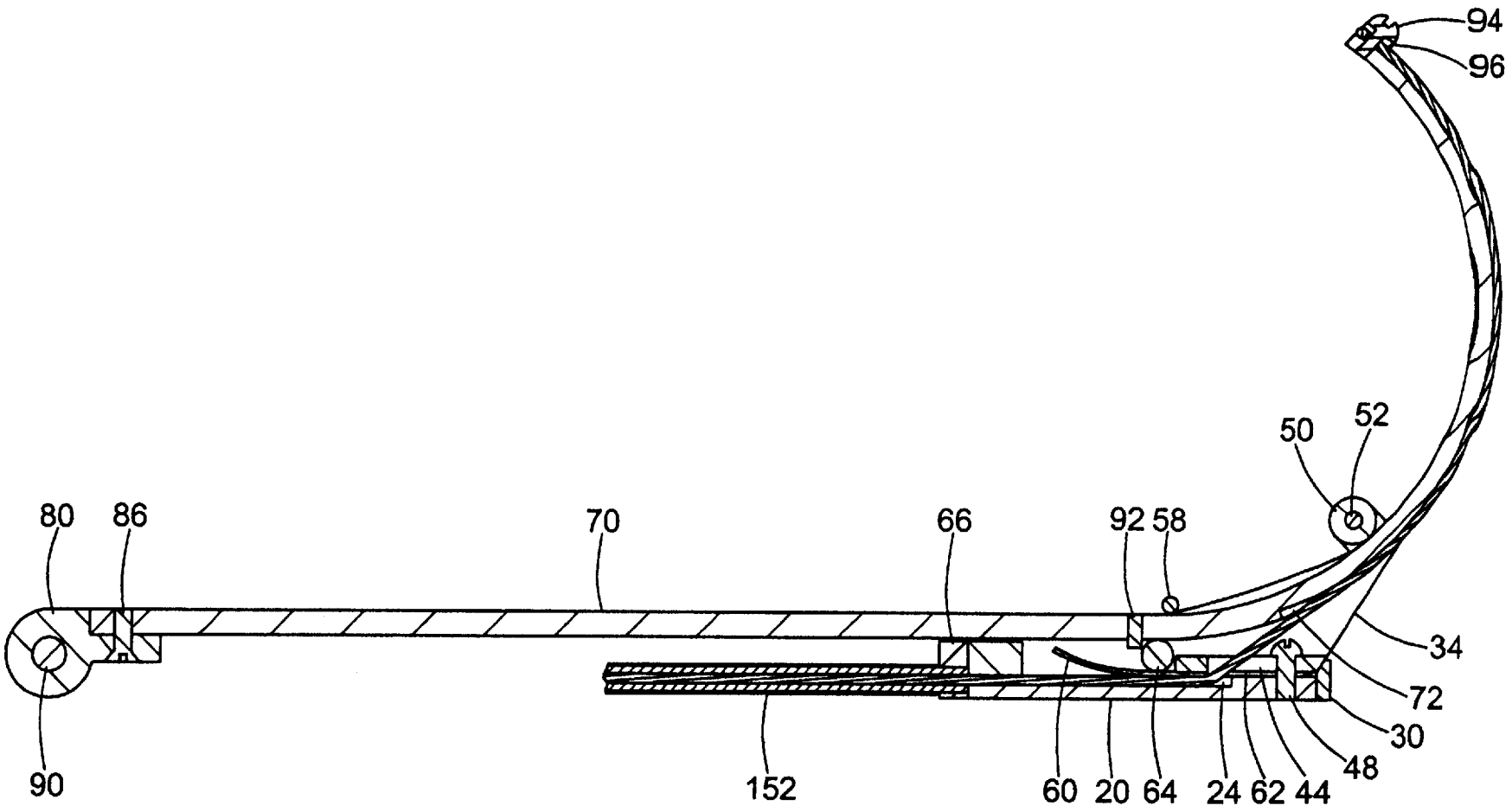
FIG. 2 shows a sectional view of the lifting mechanism.
Figure 3:
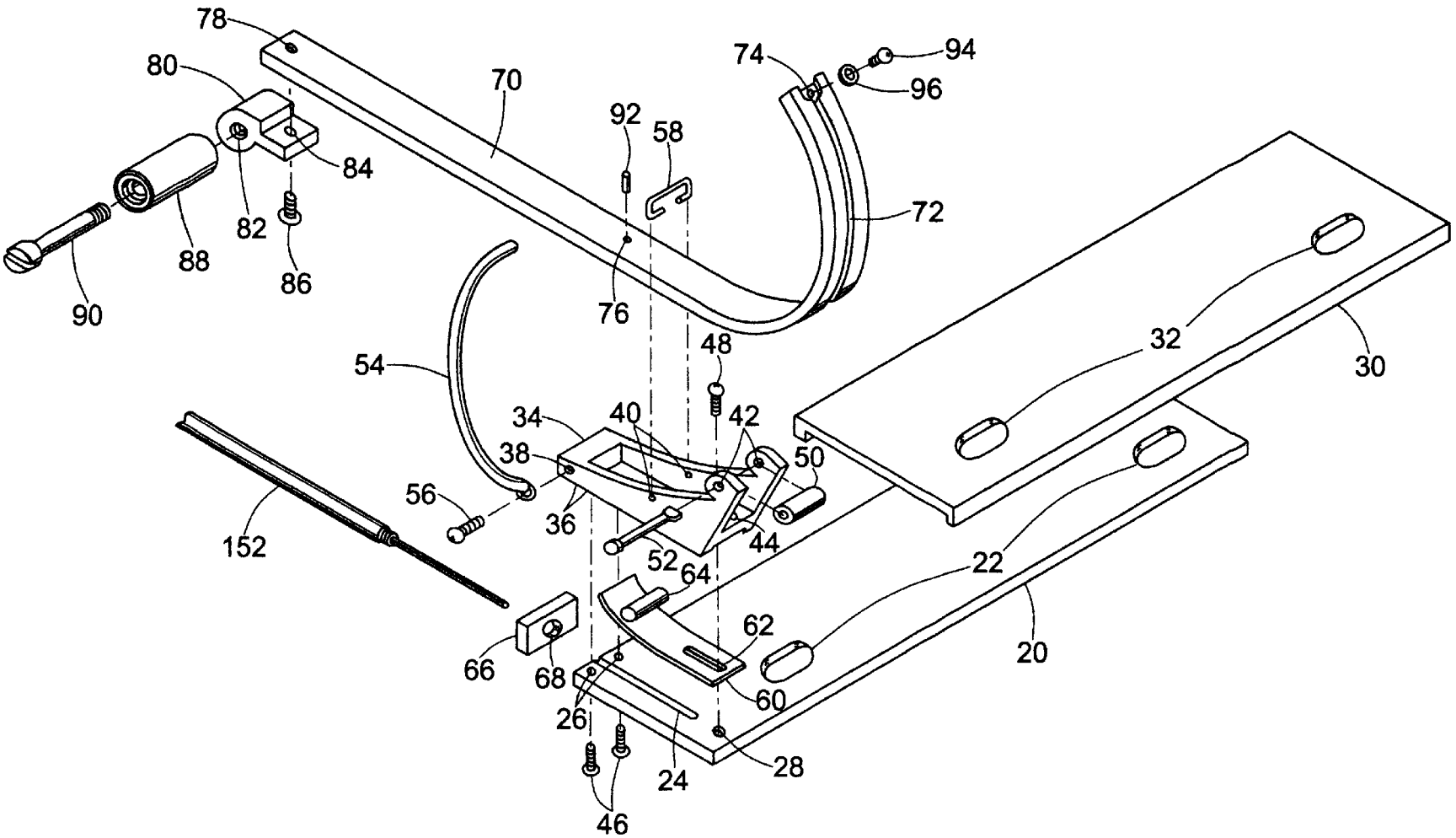
FIG. 3 shows an exploded view of the lifting mechanism.

FIGS. 2 and 3 show the details of the lifting mechanism. The lifting mechanism has a base 20 that consists of rigid material such as aluminum alloy or any other suitable materials. The base is typically 4 mm in thickness and has overall dimensions 198 mm by 54 mm. Owing to a variety of types of toilets or toilet seats, however, the dimensions of the base may vary. Two slots 22 are formed on the base. They are 18 mm in length and 12 mm in width. The distance between the centerline of the slots and the front edge of the base is 38 mm. The slots are 120 mm apart, and the slot on the left is 10 mm from the end edge of the base. A groove 24 is formed at one end of the base. The groove is 43 mm in length, 2 mm in width and 1.5 mm in depth. The distance between the centerline of the groove and the end edge of the base is 9 mm. A pair of through-holes 26 is evenly spaced on two sides of the groove. The holes are 2.5 mm in diameter and have a countersunk end. The centers of the holes are 4 mm from the front edge of the base and 10 mm from each other. A threaded hole 28 is drilled on the base aligning with the groove. The hole has a nominal diameter of 2.5 mm. The center of the hole is 6.25 mm from the rear edge of the base.

A base cover 30 resides on the base. The base cover has overall dimensions 182 mm by 60 mm. The thickness of the cover ranges from 3 mm to 8 mm to fit various types of toilet seats. The front edge of the cover that measures 4 mm thick is 4 mm higher than the body. The rear edge and one of the end edges are also 4 mm higher but only 2 mm in thickness. On the base cover are two slots 32 that have the same dimensions as slots 22 located on base 20. The base cover consists of rigid plastic such as ABS, PVC or any other suitable materials.

A carriage 34 is employed by the lifting mechanism. The carriage is 18 mm in width. Its baseline is 54 mm in length. The front end of the carriage is 8 mm in length and 6 mm in height. A pair of threaded holes 36 is drilled at the bottom of the front end. The holes have a nominal diameter of 2.5 mm and a depth of 3 mm. The centers of the holes are 4 mm from the front edge and 10 mm from each other. A threaded hole 38 is drilled on the outer side of the front end. The hole has a nominal diameter of 2.5 mm and a depth of 3 mm. The center of the hole is 4 mm from the front edge and 3 mm from the top. The front end of the carriage connects with two separate arc sides that have a radius of 96 mm, an arc length of 50 mm, and a thickness of 3 mm. A pair of through-holes 40 is drilled on the arc sides. The holes are 2 mm in diameter. The center of the holes is 35 mm from the front edge of the carriage and 5 mm from the top. The arc sides terminate at separate protruding heads of the carriage. The heads form a 45 degrees angle with upward extension line of the front end. They measure 8 mm long and wide from the arc. A pair of through-holes 42 is drilled on the center of the heads. The holes are 2.5 mm in diameter. The rear end of the carriage is 0.5 mm above the baseline. It is 24 mm in length and 4 mm in height. A slot 44 is formed on the centerline of the rear end 5 mm from the front edge. It is 12 mm in length and 2.5 mm in width. The carriage preferably is made of aluminum alloy. It is mounted on the base of the lifting mechanism by screws 46 and 48.

A steel guiding roller 50 is to be mounted on the head of the carriage by a steel pin 52. The roller has an external diameter of 8 mm, an internal diameter of 2.5 mm, and a length of 12 mm.

A semicircle bar 54 is to be attached on the carriage by a screw 56. The bar has a radius of 30 mm. It is made using 2 mm diameter spring steel wire with a thin rubber coating.

A locking member 58 is to be inserted into holes 40 located on the carriage. The locking member is made of spring steel wire 2 mm in diameter.

A leaf spring 60 is to be attached to base 20 under the rear end of the carriage. The spring is 12 mm in width and 0.5 mm in thickness. Its free end has a radius of 34 mm and an arc length of 18 mm. The fixed end of the spring is 25 mm in length. A slot 62 is formed on the fixed end 5 mm from the rear edge. The slot is 12 mm in length and 2.5 mm in width.

A steel pin roller 64 movably rests on the leaf spring. The roller is 6 mm in diameter and 12 mm in length.

A cable anchor 66 is to be adhered to the front of the carriage. The dimensions of the cable anchor are 18 mm by 10 mm by 4 mm. On the anchor is a through-hole 68. It is 4 mm in diameter. The center of the hole is 6 mm from the top of the anchor. The cable anchor consists of the same material as the base cover.

A steel lifting arm 70 rotatably rests in the carriage. The lifting arm is 12 mm in width and 4 mm in thickness. It is made up of a straight portion and an arc portion. The straight portion is 160 mm in length. The arc portion has a radius of 50 mm and an arc length of 126 mm. A groove 72 is formed in the back of the lifting arm. The groove has an arc length of 109 mm, and is 2 mm in width and 1.5 mm in depth. One end of groove is widened to 6 mm that measures 6 mm long. On the center of the widened end is a threaded hole 74. The hole has a nominal diameter of 2.5 mm. A through-hole 76 is drilled in the middle of the lifting arm. It is 2 mm in diameter. The center of the hole is 166 mm from the straight end of the lifting arm. A threaded hole 78 is drilled on the straight end of the lifting arm. The hole has a nominal diameter of 3 mm. The center of the hole is 5 mm from the end edge.

A plastic roller bearing 80 is to be mounted on the straight end of the lifting arm. The bearing has a radius of 7 mm, and is 12 mm in width. A threaded hole 82 is located on the center of the bearing. It has a nominal diameter of 4 mm and a depth of 8 mm. The bearing has a protruding end that is 10 mm in length and 6 mm in height. A through-hole 84 is drilled on the end. The hole is 3 mm in diameter, and has a countersunk end. The roller bearing is screwed on the lifting arm by a screw 86.

A contact roller 88 is to be rotatably bolted on the roller bearing by a mounting bolt 90. The roller has an external diameter of 15 mm, an internal diameter of 4 mm and a length of 40 mm. It is made of rigid material such as nylon or aluminum with a thin rubber coating.

A steel pin 92 is to be inserted into hole 76 located in the middle of the lifting arm, and protrudes from the bottom for a length of 1 mm. The pin is 2 mm in diameter and 5 mm in length.

A screw 94 with a washer 96 screw into threaded hole 74 located at the arc end of the lifting arm.

Figure 4:
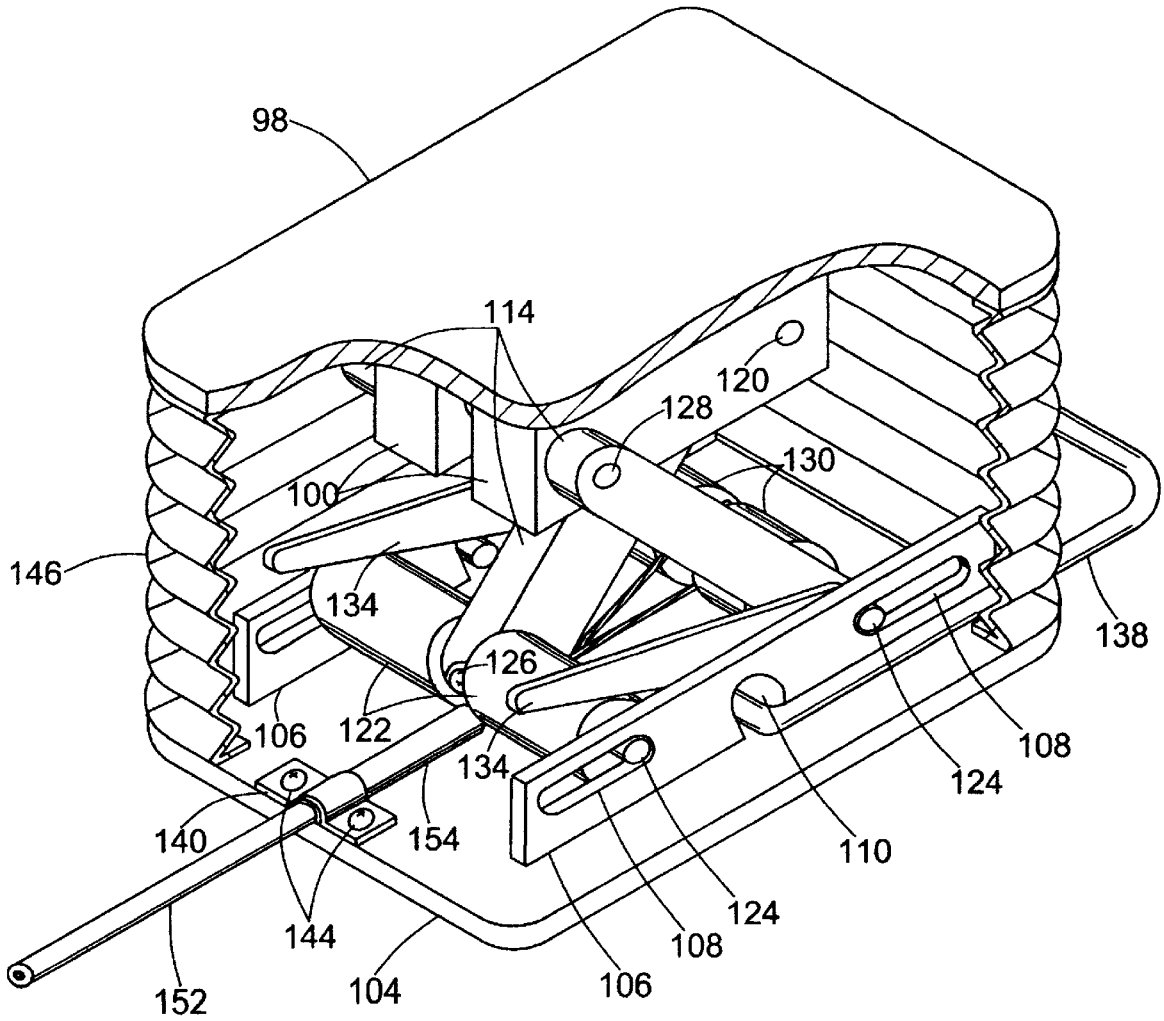
FIG. 4 shows a cut-away view of the pedal assembly.
Figure 5:
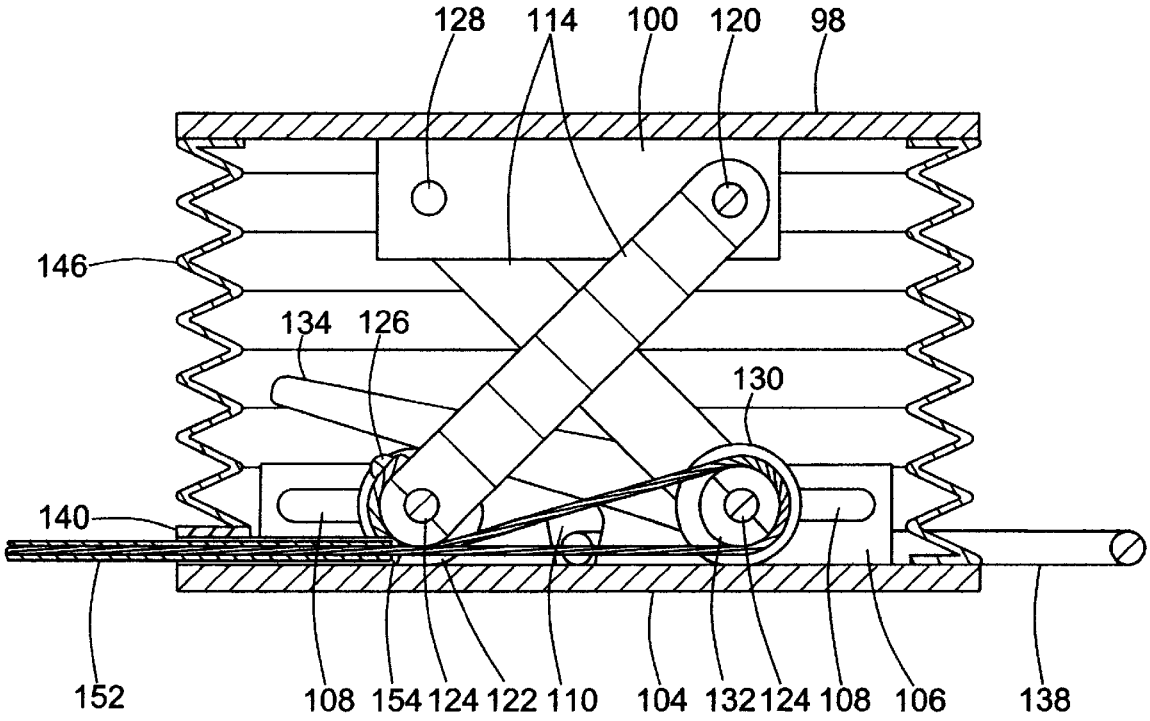
FIG. 5 shows a sectional view of the pedal assembly.
Figure 6:
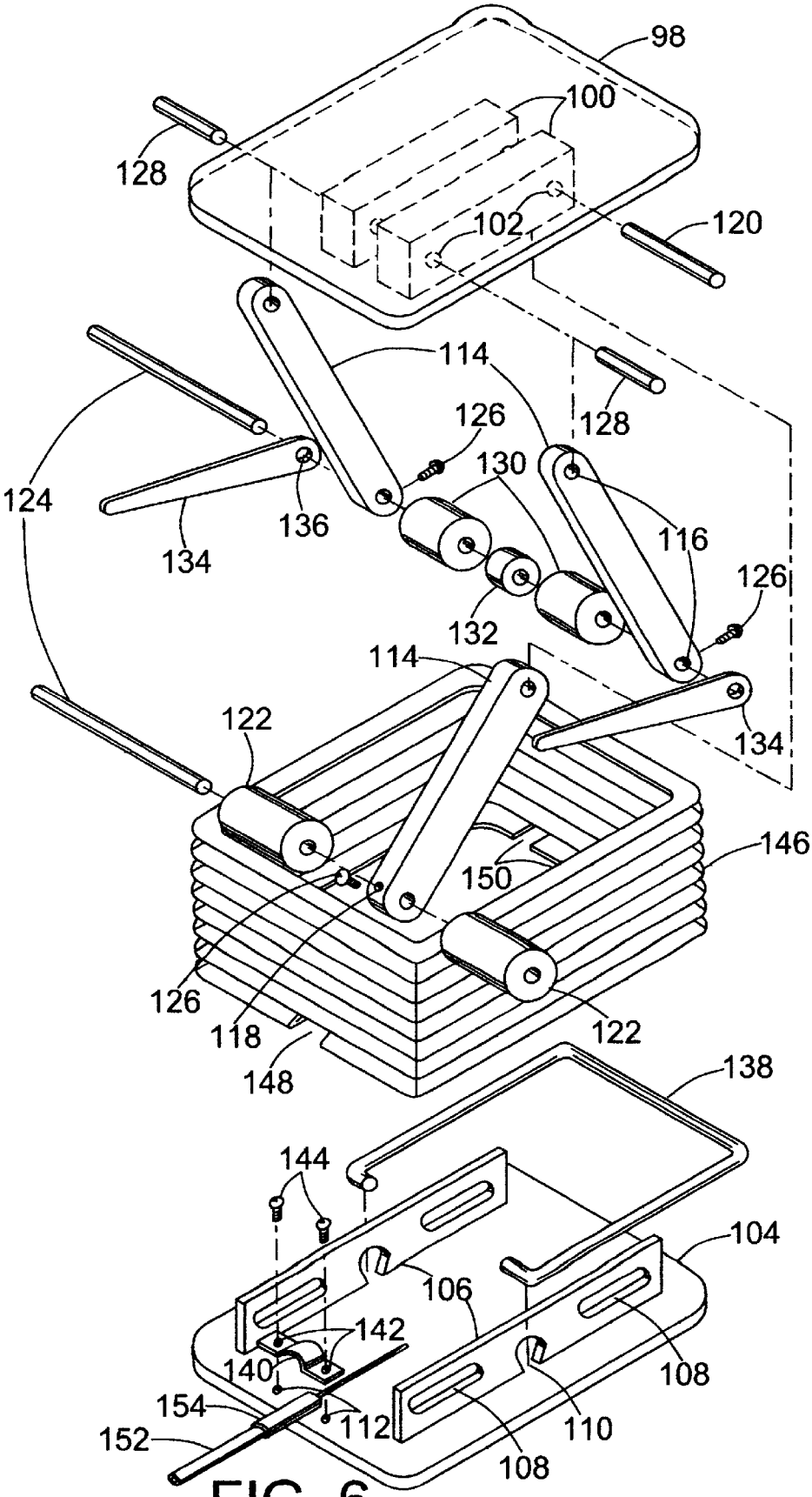
FIG. 6 shows an exploded view of the pedal assembly.

FIGS. 4–6 show the details of the pedal assembly. The pedal assembly has a foot-receiving pad 98 that consists of the rigid plastic such as PVC, ABS or any other suitable materials. The dimensions of the pad are 124 mm by 88 mm by 4 mm. Its four rounded corners are 14 mm in radius. A pair of link mounts 100 is formed at the underside of the pad evenly spacing on two sides of the centerline. The dimensions of the mounts are 60 mm by 14 mm by 20 mm. They are 8 mm apart. A pair of through-holes 102 is drilled on the mounts. The holes are 5 mm in diameter. The distance between the centers of the holes is 45 mm.

The pedal assembly has a base 104, which consists of the same material and has the same dimensions as the foot-receiving pad. A pair of guides 106 is formed on the base evenly spacing on two sides of the centerline. The dimensions of the guides are 100 mm by 3 mm by 17 mm. They are 52 mm apart. A pair of slots 108 is formed on the guides. The slots are 24 mm in length and 5 mm in width. The distance between them is 40 mm. In the middle of the guides is a notch 110. The notch is 12 mm in height. Its top is 5 mm in radius, and its bottom is 6 mm in width. On one end of the base are two threaded holes 112 evenly spaced on two sides of the centerline. The holes have a nominal diameter of 2.5 mm. The centers of the holes are 5 mm from the end edge of the base and 14 mm from each other.

The pedal assembly employs three links 114. The dimensions of the links are 78 mm by 14 mm by 8 mm. At each end of the links is a through-hole 116. The holes are 5 mm in diameter. The distance between the centers of the holes is 64 mm. A threaded hole 118 is drilled on one end of the links. The hole has a nominal diameter of 2.5 mm. It intersects with through-hole 116 at right angles. The links preferably are made of aluminum alloy. However, they can be made of any other suitable materials.

One of the links is pivotally mounted between the link mounts by a steel pin 120 at one end, and together with two nylon rollers 122 is movably mounted on base 104 by a steel axle 124 at another end. The pin is 5 mm in diameter and 36 mm in length. The rollers have an external diameter of 20 mm and a length of 22 mm. The axle is 5 mm in diameter and 58 mm in length. Its two ends protrude into the slot located on guides 106. The link is fixed on the axle by a screw 126. The other two links are pivotally mounted on outer side of the link mounts by two steel pins 128 at one end, and together with two nylon rollers 130 are movably mounted on base 104 by another axle 124. The pins are 5 mm in diameter and 22 mm in length. Rollers 130 have an external diameter of 20 mm and a length of 12 mm. The two links are also fixed on the axle by screws 126.

A steel bushing 132 is to be mounted on the axle between rollers 130. The bushing has an external diameter of 14 mm and a length of 6 mm.

A pair of steel bars 134 is also mounted on the axle with rollers 130. The bars are 61 mm in length, 3 mm in thickness. One end of the bar is 6 mm in width. Another end has a radius of 7 mm. A through-hole 136 is located at rounded end of the bars. The hole is 5 mm in diameter.

The pedal assembly has a lever 138 movably attached to it. The lever is made of 5 mm diameter steel rod. It is 85 mm in length and 68 mm in width. Its two ends are inserted into the notches located in the guides, and protrude from there for a length of 2.5 mm.

The base of the pedal assembly has a bracket 140 attached to it. The bracket has a radius of 3.5 mm and is made using 1 mm thick steel sheet. At each end of the bracket is a through-hole 142. The holes are 2.5 mm in diameter. Screws 144 screw the bracket on the base.

A bellows 146 is to be bonded to the foot-receiving pad at one end and to the base of the pedal assembly at another end. The bellows has overall dimensions 122 m*88 mm. A notch 148 is formed at one of the short sides of the bellows to allow bracket 140 to be mounted on the pedal base. Two notches 150 are formed at the opposite side of the bellows to allow lever 138 to be attached to the pedal assembly.

A cable 152 that is exactly the same as brake cable or gear cable of the bicycles connects the lifting mechanism and the pedal assembly. It is about 1200 mm in length. A steel cable cap 154 is to be attached to one end of the cable. The cable cap has an external diameter of 6 mm and a length of 30 mm. One end of the cable is to be inserted into the cable anchor adhered on the front of the lifting mechanism. It in turn goes through groove 24 formed on base 20, and slot 52 located on the leaf spring and slot 40 formed on the rear end of the carriage. It then gets into groove 66 formed in the back of the lifting arm, and is screwed down at the end of the lifting arm by screw 88 and washer 90. Another end of the cable on which the cable cap attached is to be inserted into bracket 140 mounted on the base of the pedal assembly. From there it goes all the way down to the back of the pedal assembly. After going around bushing 132 mounted on the axle, it returns to the front and is screwed on the end of the link by screw 126.

From the description above, a number of advantages of my invention become evident:

(a) the lift can be simply manufactured without any complicated production procedures or special facilities.

(b) the lift is made of such materials which are common, cheap and substitutable.

(c) the lift is very flexible in sizes or dimensions so that it can fit a variety of types of toilets and toilet seats.

Operation—FIGS. 7–13

Figure 7:
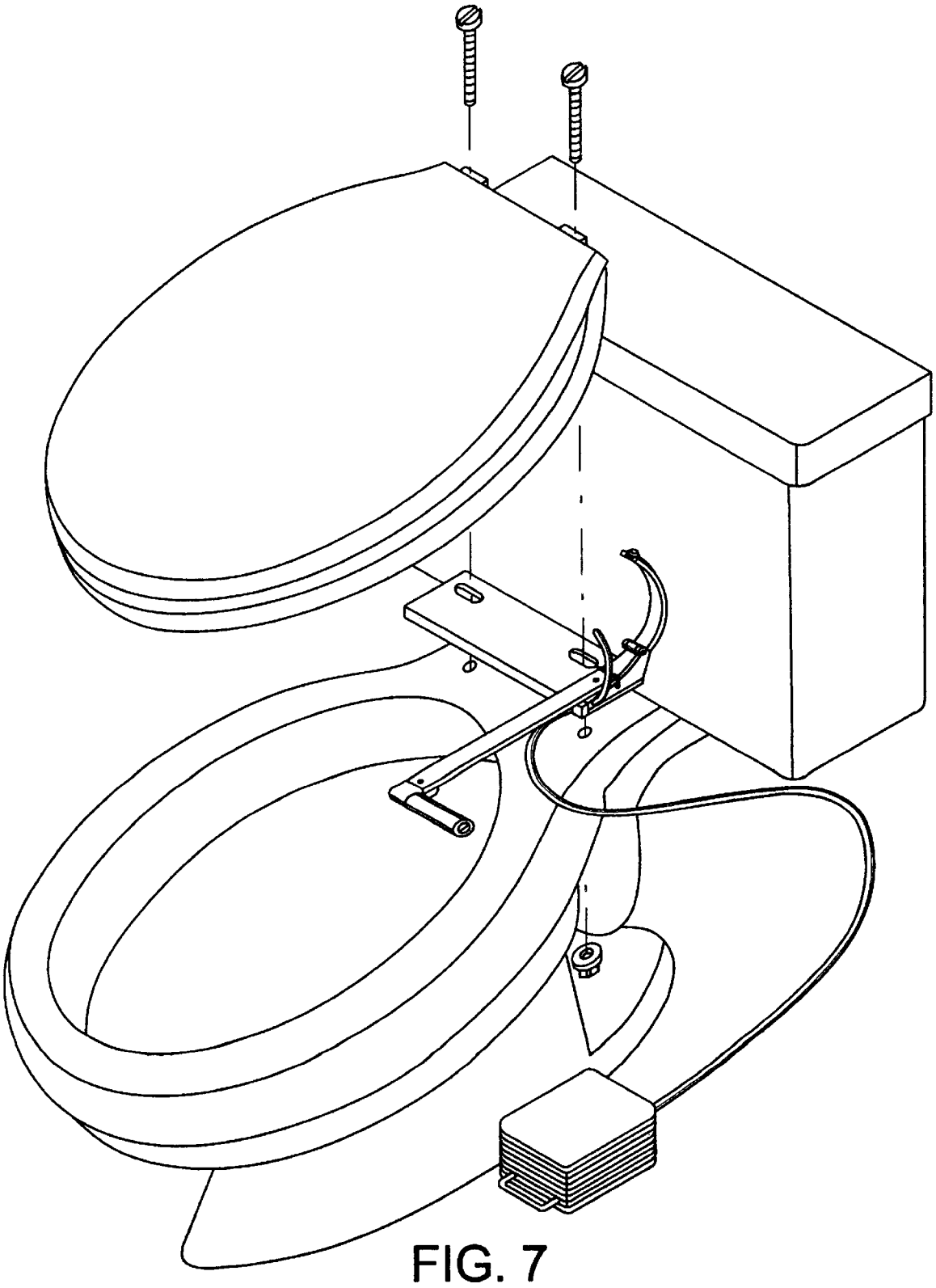
FIG. 7 shows the lift installation procedures.
Figure 8:
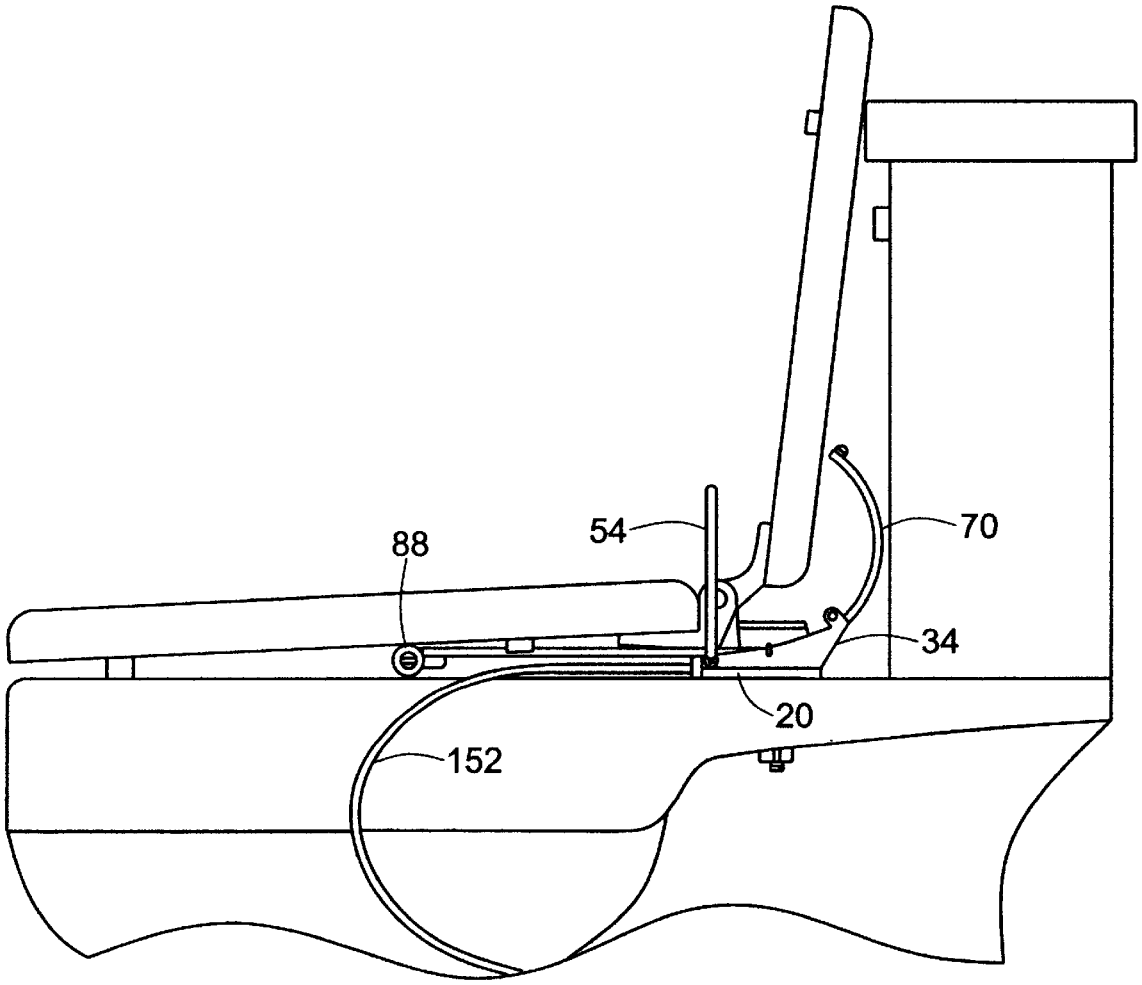
FIG. 8 shows the lifting mechanism installed on toilet.
Figure 9:
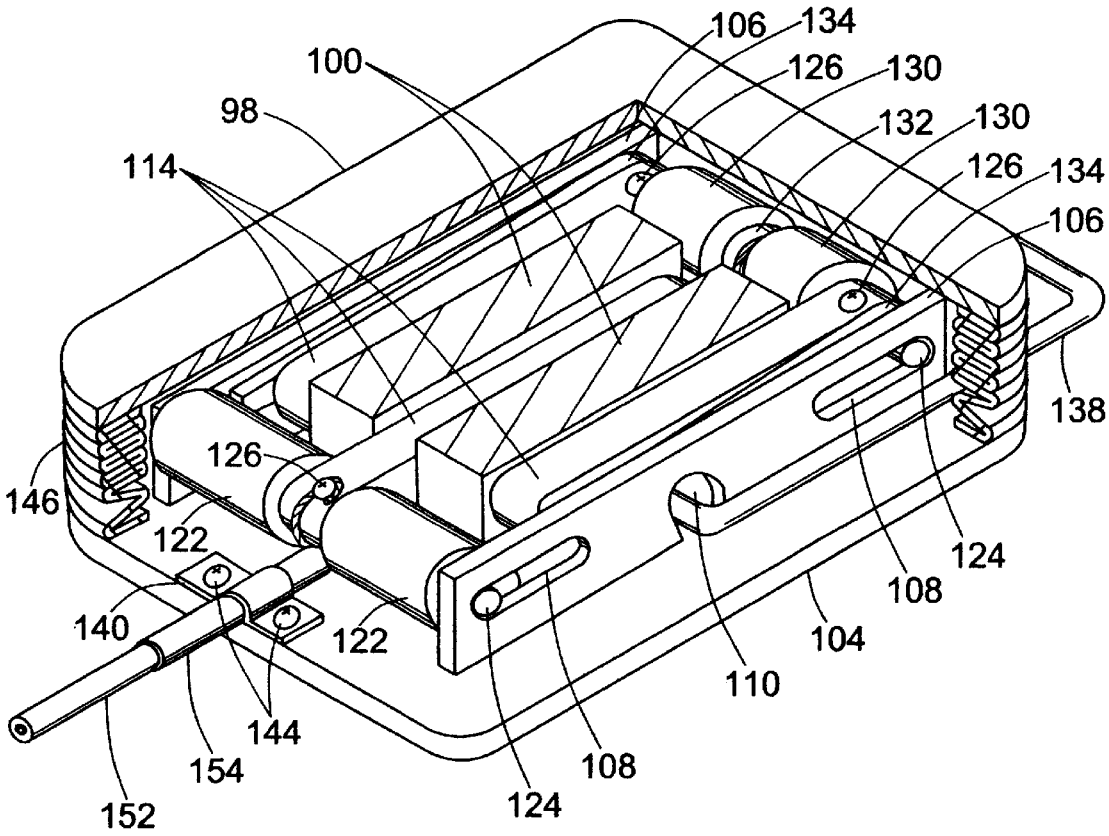
FIG. 9 shows a cut-away view of the pedal assembly in operation.
Figure 10:
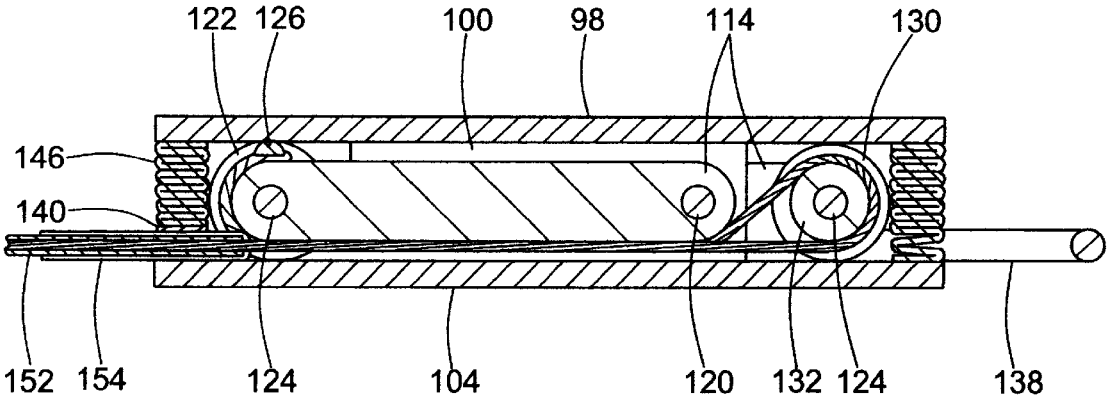
FIG. 10 shows a sectional view of the pedal assembly in operation.
Figure 11:
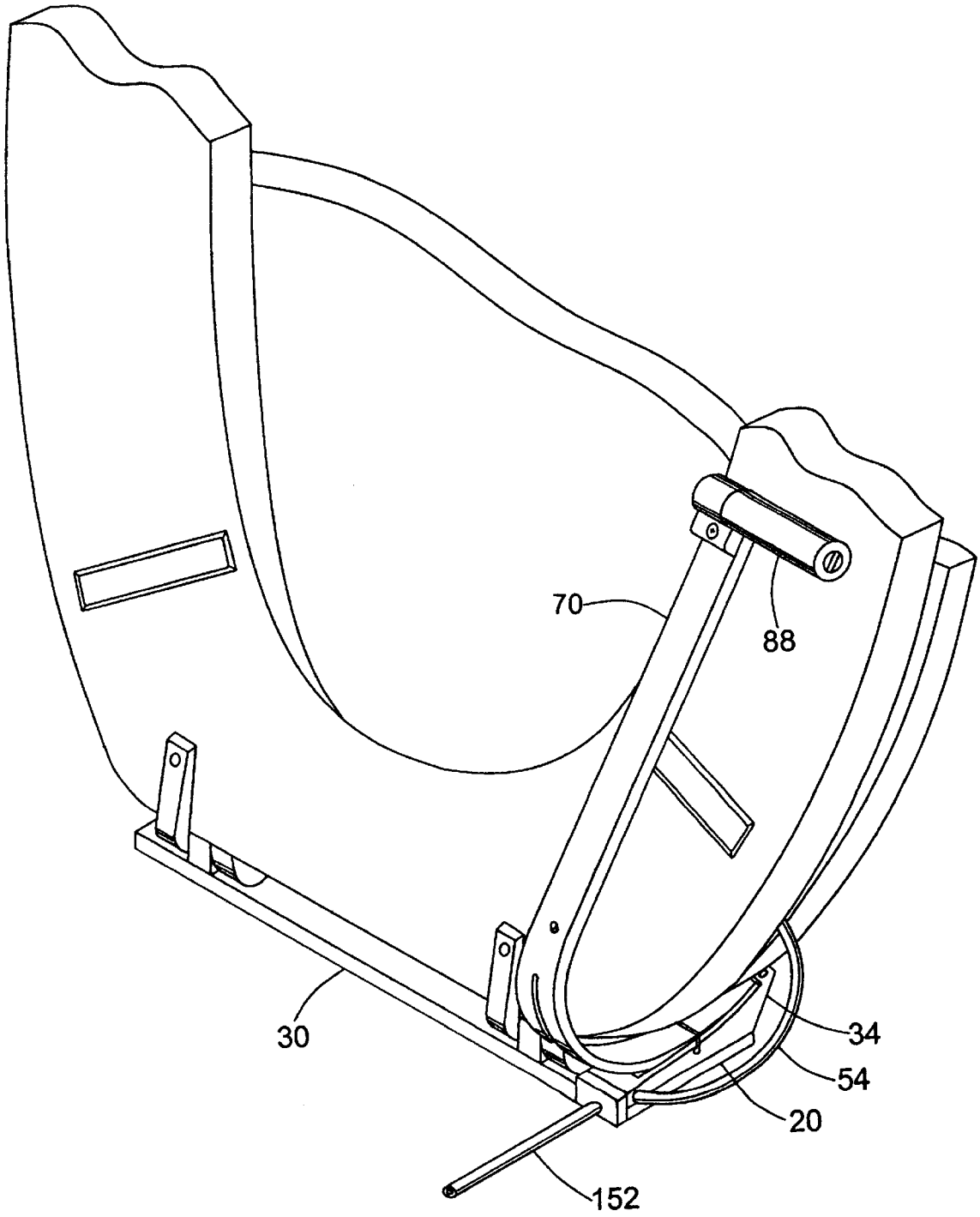
FIG. 11 shows an isometric view of the lifting mechanism in operation.
Figure 12:
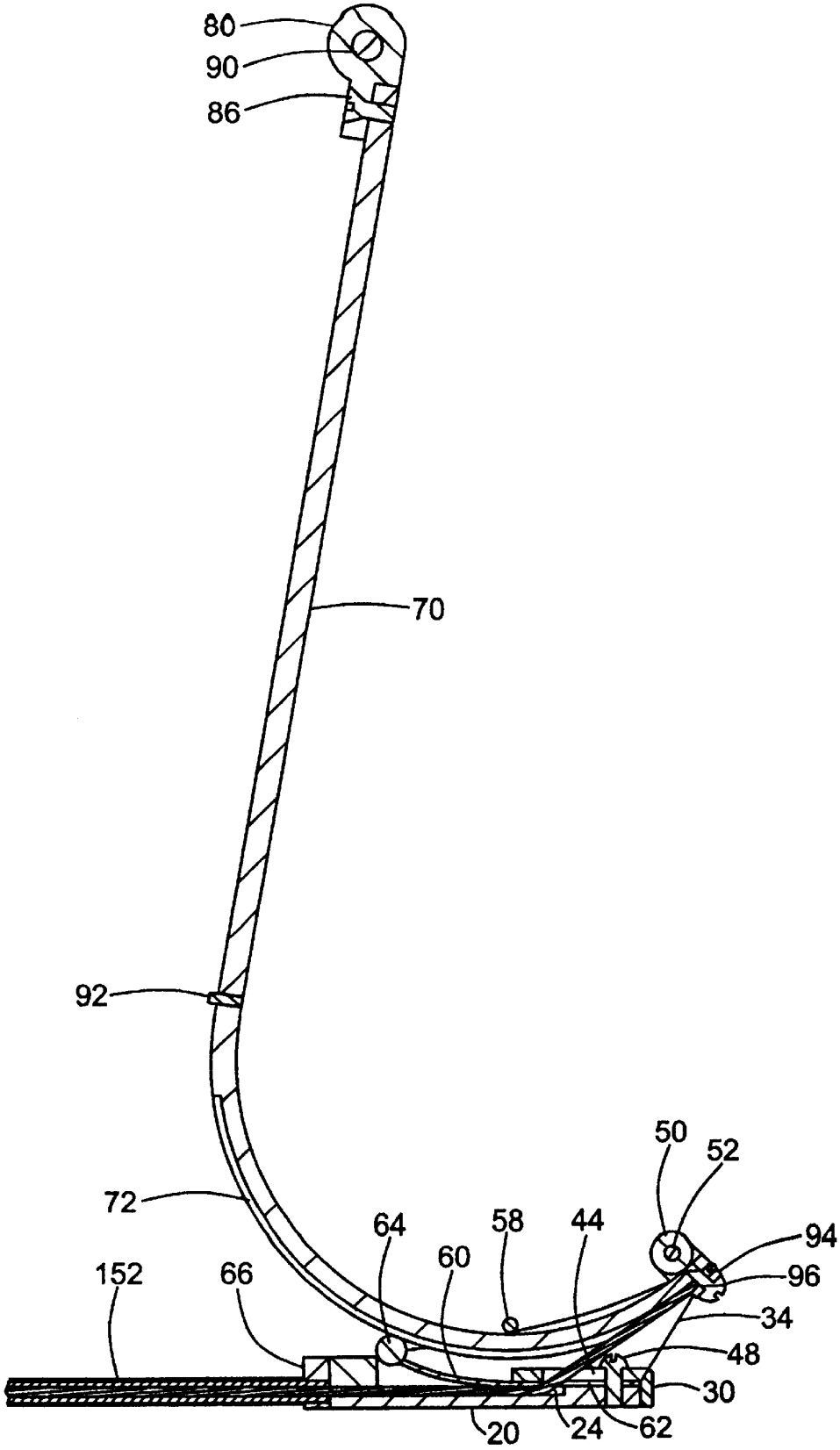
FIG. 12 shows a front view of the lifting mechanism in operation.
Figure 13:
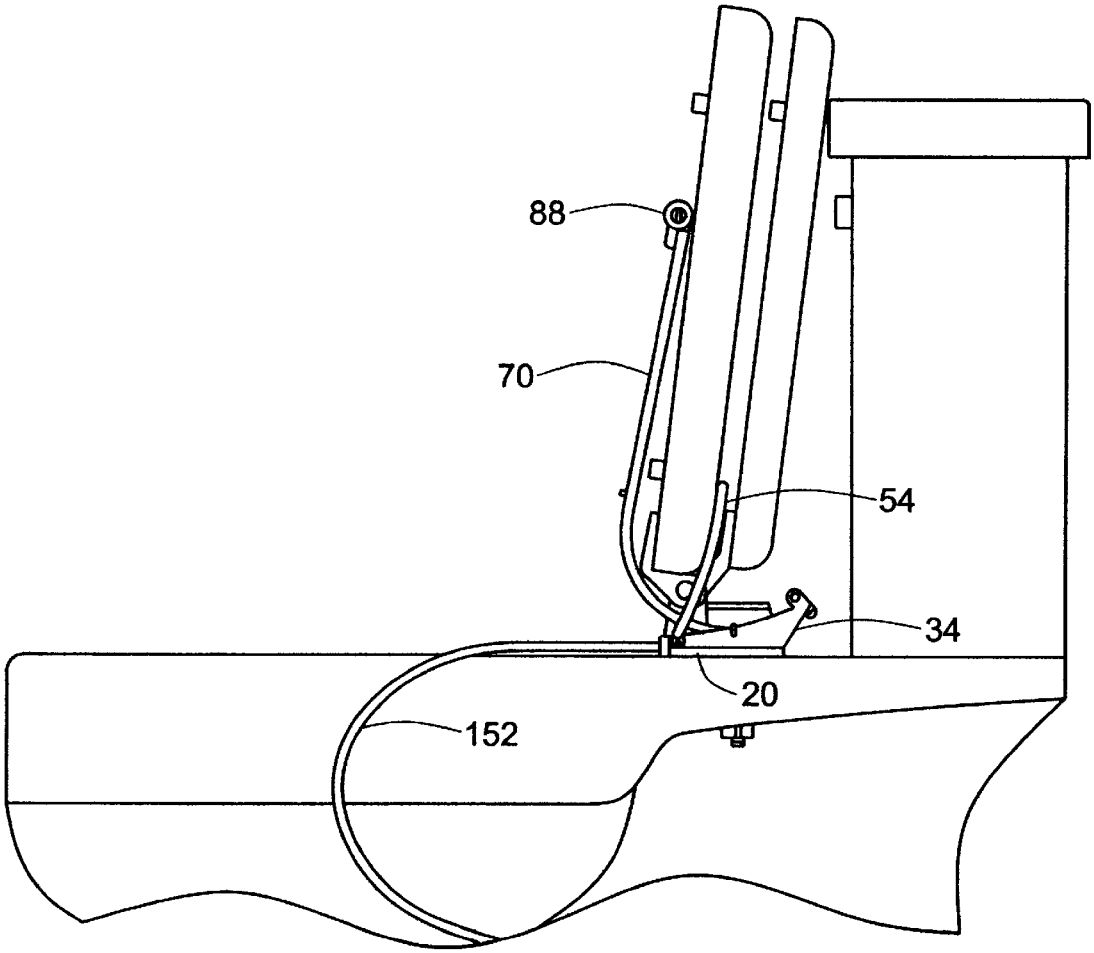
FIG. 13 shows a sectional view of the lifting mechanism in operation.

FIGS. 7 and 8 show the lift installation procedures. The base of the lifting mechanism is to be put on toilet bowl under toilet seat so that the lifting mechanism can be mounted on toilet along with a toilet seat by toilet seat fixtures. Slots 22 formed on the base make the lifting mechanism adjustable on toilet bowl so that it may be positioned wherever needed to lift a toilet seat. Base cover 30 makes the lift suitable for various types of toilet seats. Namely, by changing the thickness of the base cover to adjust the space between the top of a toilet bowl and the underside of a toilet seat, the lift can get sufficient clearance for its lifting arm to turn no matter how small the space is originally.

FIGS. 9–13 show the lifting operation. As force from a toilet user's foot is applied to foot-receiving pad 98, links 114 pivotally attached to the underside of the pad and guided by guides 106 located on the pedal base are fully extended. The extended links push cable cap 154 that is in contact with one of the links forward, and pull cable 152 through cable sheath for a length of 87 mm so that the force from a toilet user's foot is converted into a dragging power. Rollers 122 and 130 mounted on axles 124 with the links make the motion smoothly. Bushing 132 rotatably mounted on one of the axles functions to reduce the friction caused by the moving cable.

As the dragging power is provided, lifting arm 70 resting in carriage 34 under guiding roller 50 makes its motion by swinging through an arc 100 degrees. The sufficiently great arc portion of the lifting arm prevents it from being stuck by hinged end of a toilet seat. Pin roller 64 resting on leaf spring 60 serves to carry the lifting arm and makes it move briskly by rolling along with it until the roller gets to the free end of the leaf spring. The leaf spring provides an upward force for the lifting arm as it turns. Contact roller 88 bolted on roller bearing 80 which is attached to the end of the lifting arm keeps rolling at the underside of toilet seat as the lifting arm turns, the toilet seat then is lifted to an upright position. Locking member 58 secures the lifting arm from coming out of the carriage.

The lifting operation ends when a swinging-up toilet seat is blocked by semicircle bar 54 mounted on the carriage. One of the functions the semicircle bar performs is to reduce the impact of a toilet seat against seat cover. Meanwhile, on the pedal assembly bars 134 mounted on one of axles drop down from the top of rollers 122 to the ends of lever 138 as the links are fully extended. They block the links' way back and keep them remaining in a horizontal position. As the result, the cable is stretched, and the lifting arm is held in its working position against an upright toilet seat.

To get an upright toilet seat reseated, toilet users press pedal releasing lever 138 by foot. The ends of the lever push bars 134 upward, which enables the links to move back, and gets the pedal pad raised as well. Consequently, the cable cap along with the compressed cable sheath slide back by themselves, and the stretched cable is loosened. The lifting arm that loses the dragging power is then forced back by a swinging-down toilet seat which gains the pushing power from the semicircle bar first, and from its own weight later. Pin roller 64 held on the free end of the leaf spring by an insufficient clearance between the lifting arm and the leaf spring keeps rolling under the lifting arm. The leaf spring functions as a cushion to reduce the impact of a falling toilet seat against toilet bowl until the leaf spring is eventually forced down. The pin roller then gains sufficient space and is pushed back from the free end of the leaf spring by pin 92 mounted on the bottom of the lifting arm. When the lifting arm is forced back to its starting position by toilet seat, the toilet seat itself is reseated on toilet bowl.

SUMMARY, RAMIFICATIONS, AND SCOPE

Accordingly, The reader will see that the foot actuated toilet seat lift of this invention can be used conveniently, produced economically, and installed quickly without changing anything on the toilets or toilet seats that are currently in use. Furthermore, the invention has the additional advantages in that.

This small, simple and delicate device enables the users to keep their bathroom as nice as it used to be, instead of ruining it by a big complicated apparatus.

This device makes life more enjoyable by not only providing the convenience for toilet users, but by varying its designs or colors.

This device provides a lifting method for not only toilet seats but also some other utensils or equipment that are similar in structures or working manners as toilet seats.

Although the description above contains many specifications, these should not be construed as limiting the scope of the invention. The scope of the invention should be determined by the opened claims and their legal equivalents.

I claim:

1. A foot actuated toilet seat lift comprising:

a) a lifting mechanism having a base adapted to be mounted on a toilet, a base cover resting on top of said base, a carriage mounted on one end of said base, a guiding roller rotatably attached to a head of said carriage, a semicircle bar attached to one side of said carriage, a leaf spring mounted on one end of said base under said carriage, a pin roller movably resting on said leaf spring, a lifting arm, having a curved end and a straight end, rotatably resting in said carriage under said guiding roller, a contact roller rotatably attached to the straight end of said lifting arm, b) a pedal assembly having a foot-receiving pad and a base having a top, a number of links pivotally attached at underside of said foot-receiving pad at one end and movably attached on said base of said pedal assembly at another end, a number of rollers rotatably attached to said links, a means for locking and releasing said pedal assembly, and a bellows bonded on underside of said foot-receiving pad at one end and on said base of said pedal assembly at another end, c) means for transmitting the power provided by toilet users' foot from said pedal assembly to said lifting mechanism.

2. The lift of claim 1 wherein said base of said lifting mechanism has two slots formed in predetermined locations.

3. The lift of claim 1 wherein said base of said lifting mechanism has a groove formed at one end thereof.

4. The lift of claim 1 wherein said carriage has a front end and a rear end adapted to be mounted on said base of said lifting mechanism.

5. The lift of claim 4 wherein said rear end of said carriage has a slot formed on the centerline thereof.

6. The lift of claim 1 wherein said lifting arm has a groove with an enlarged end formed on the back thereof.

7. The lift of claim 1 wherein said foot-receiving pad has a pair of link mounts located at the underside thereof.

8. The lift of claim 1 wherein said base of said pedal assembly has a pair of guides located on the top thereof.

9. The lift of claim 8 wherein said guides have a notch located in the middle thereof.

10. The lift of claim 9 wherein said guides have a pair of slots evenly spaced on two sides of said notch.

* * * * *